US009476235B2

(12) United States Patent
Jian et al.

(10) Patent No.: US 9,476,235 B2
(45) Date of Patent: Oct. 25, 2016

(54) HIDDEN HINGE AND CONTAINER, AND HINGE FIXING STRUCTURE THEREFOR

(71) Applicant: SHANGHAI HONGYAN RETURNABLE TRANSIT PACKAGING CO., LTD, Shanghai (CN)

(72) Inventors: Yuanli Jian, Shanghai (CN); Lunliang Mou, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 0 days.

(21) Appl. No.: 14/420,567

(22) PCT Filed: Aug. 7, 2013

(86) PCT No.: PCT/CN2013/081014
§ 371 (c)(1),
(2) Date: Feb. 9, 2015

(87) PCT Pub. No.: WO2014/023235
PCT Pub. Date: Feb. 13, 2014

(65) Prior Publication Data

US 2015/0197971 A1 Jul. 16, 2015

(30) Foreign Application Priority Data

Aug. 7, 2012 (CN) ..... 2012 1 0279538

(51) Int. Cl.
*E05D 7/00* (2006.01)
*B65D 25/00* (2006.01)
(Continued)

(52) U.S. Cl.
CPC ..... *E05D 7/00* (2013.01); *B65D 25/005* (2013.01); *B65D 90/008* (2013.01);
(Continued)

(58) Field of Classification Search
CPC .... E05D 7/00; B65D 25/005; B65D 90/008; B65D 88/121; B65D 88/12; B65D 11/1866; B65D 11/1833
USPC ..... 220/4.28, 4.33, 4.34, 7, 6, 254.6, 254.3, 220/254.1, 1.5; 206/600, 386; 16/319
See application file for complete search history.

(56) References Cited

U.S. PATENT DOCUMENTS 4,674,647 A * 6/1987 Gyenge ..... B65D 19/18 220/1.5
4,923,079 A * 5/1990 Foy ..... B65D 19/18 220/326

(Continued)

FOREIGN PATENT DOCUMENTS

CN 1473523 2/2004
CN 102502124 6/2012

(Continued)

OTHER PUBLICATIONS

International Search Report for international application No. PCT/CN2013/081014, dated Oct. 31, 2013 (6 pages).

*Primary Examiner* — Robert J Hicks
(74) *Attorney, Agent, or Firm* — Hamre, Schumann, Mueller & Larson, P.C.

(57) ABSTRACT

A hinge fixing structure used to hold a hidden hinge on a container, and a hidden hinge and a container. The hidden hinge comprises an upper hinge base, a hinge body and a lower hinge base. The container comprises a side plate and a door, which are respectively provided with grooves formed by the internal and external sidewalls thereof and used to accommodate hinge bases. The hinge fixing structure comprises position limiting structures located in grooves and used to prevent the hinge bases from releasing from the mouth portions of grooves and positioning structures provided on the upper hinge base and the lower hinge base and engaged with the limiting structures respectively. The position limiting structures are engaged with the positioning structures respectively so that the hidden hinge is held on the container, and the hidden hinge is completely invisible from the appearance of container when the door is closed.

10 Claims, 13 Drawing Sheets

(51) Int. Cl.

| | |
|---|---|
| ***B65D 90/00*** | (2006.01) |
| ***E05D 5/02*** | (2006.01) |
| ***E05D 7/12*** | (2006.01) |
| *E05D 3/12* | (2006.01) |

(52) U.S. Cl.
CPC ..... *E05D 5/0223* (2013.01); *E05D 7/125* (2013.01); *E05D 3/12* (2013.01); *E05Y 2600/53* (2013.01); *Y10T 16/54* (2015.01)

(56) References Cited

U.S. PATENT DOCUMENTS

| | | | | |
|---|---|---|---|---|
| 4,928,350 | A * | 5/1990 | Morgan | E05D 3/12 16/297 |
| 5,161,709 | A * | 11/1992 | Oestreich, Jr. | B65D 19/12 220/1.5 |
| 5,938,059 | A * | 8/1999 | Luburic | B65D 11/1833 220/4.32 |
| 7,416,092 | B2 * | 8/2008 | Dubois | B65D 19/18 206/511 |
| 7,484,634 | B2 * | 2/2009 | Apps | B65D 19/18 220/6 |
| 8,066,147 | B2 * | 11/2011 | Meers | B65D 11/184 206/600 |
| 8,109,402 | B2 * | 2/2012 | Hartwall | B65D 19/18 206/600 |
| 2002/0070215 | A1 * | 6/2002 | Walsh | B65D 19/18 220/6 |
| 2009/0152265 | A1 | 6/2009 | Nolan | |

FOREIGN PATENT DOCUMENTS

| | | |
|---|---|---|
| CN | 102530348 | 7/2012 |
| CN | 102582912 | 7/2012 |
| CN | 202302310 | 7/2012 |
| CN | 102758572 | 10/2012 |
| CN | 202718503 | 2/2013 |
| JP | 2012-030836 | 2/2012 |
| WO | 2009/023830 | 2/2009 |

* cited by examiner

HIDDEN HINGE AND CONTAINER, AND HINGE FIXING STRUCTURE THEREFOR

FIELD

The present invention relates to containers, in particular to hinge fixing structures and hidden hinges used to fix hidden hinges to containers.

BACKGROUND

As we all know, currently it is very common to employ containers to carry or transport various types of materials, and these containers are of a series of specifications from the big to the small. In the purposes of convenience quickness of production turnover or transportation, and savings of costs, plastic containers become widespread. Such containers mostly have a bottom and integrated or foldable four side plates. When the volume of the container is too large, a door that can be opened is usually provided at one or more side plates for easy access to items at the bottom of the container or for installation or disassembly of some additional components at the bottom of the container. Typically, the door that can be opened flushes with the side plate, and has a locking mechanism ensuring that it would not be accidentally opened. When it is needed to open the door, after being unlocked, the door is flipped outwardly by approximately 180 degrees and then is lean against the side plate substantially, so as to reduce the space it occupies, and makes it more convenient for people to operate through an opening of the side plate.

Chinese patent application No. 201210031893.7 shows a novel method for connecting the door and the side plate, the entire disclosure of which is incorporated herein by reference. As shown in FIG. 1, it uses a generally U-shaped hinge body, which is provide with at least two groups of hinge pins, respectively connected with the upper and lower hinge bases, wherein the upper hinge base is connected with the door and the lower hinge base is connected with the side plate. The upper and lower hinge base may both be rotated by 90 degrees around the hinge pins of the hinge body, in this way, the door could be flipped outwardly relative to the side plate by 180 degrees. More advantageously, the hinge body, the upper and lower hinge bases could be arranged within the thickness between the internal and external surfaces of the side plate. When the door is closed, the hinge is substantially invisible from the appearance of the container.

Although the hidden hinge described above can greatly improve the overall product appearance, however, since there are hinge mounting holes provided at the hinge mounting parts of the side plate and the door, and the hinge mounting holes and the hinge positioning structures will still be seen from the appearance of the container after the hinge is installed. Further, since the hinge mounting holes are provided on the side plate and the door, and therefore, the strength of the hinge mounting parts on the side plate and the door is also affected to some extent.

SUMMARY

The object of the present invention is to provide a structure used to hold a hidden hinge on a container, so that after installation, the hinge is completely invisible from the appearance of the container, and the disassembly of the hinge becomes more convenient.

To achieve the above object, according to first aspect of the present invention, there is providing a hinge fixing structure used to hold a hidden hinge on a container, wherein said hidden hinge comprises an upper hinge base, a hinge body and a lower hinge base, and said container comprises a side plate and a door which are respectively provided with grooves formed by the internal and external sidewalls thereof and used to accommodate the hinge bases, characterized in that said hinge fixing structure comprises:

position limiting structures located in said grooves and used to prevent the hinge bases from releasing from mouth portions of said grooves respectively, and positioning structures provided on said upper hinge base and said lower hinge base and engaged with said position limiting structures respectively; wherein said position limiting structures are engaged with said positioning structures respectively so that said hidden hinge is held on the said container and said hidden hinge is completely invisible from the appearance of said container when the door is closed.

In a preferred embodiment of the present invention, said position limiting structures comprise positioning ribs located at the bottom of the grooves respectively and hanging protrusions located at the mouth portions of said grooves respectively;

said positioning structures are branches extending from the left and right side of the hinge bases; and said positioning ribs are used to prevent the hinge bases from moving around, and said hanging protrusions are engaged with said branches so as to prevent the hinge bases from releasing from said grooves.

In the above embodiment, said branches are elastic pieces extending integrally from the left and right side of the hinge base respectively, and projections are provided at the ends of said elastic pieces respectively; and said hanging protrusions are tabs extending from both sides of the mouth portions of the grooves, wherein said tabs are engaged with said projections respectively so as to prevent the hinge bases from releasing from said grooves.

In the above embodiment, said positioning ribs are columnar members extending from the bottom surfaces of the grooves so that said hinge bases are held between two columnar members after installation.

In another preferred embodiment of the present invention, said position limiting structures are hanging slots located at the bottom of said grooves;

said positioning structures comprise elastic pieces extending from the left sides or the right sides of the hinge bases and hanging protrusions provided on the front sides or the rear sides of the hinge bases; and said hanging slots are engaged with said hanging protrusions respectively so as to prevent the hinge bases from releasing from said grooves.

In the above embodiment, said hanging protrusions are two protrusions extending integrally from one of the front and rear sides of each hinge base, and said hanging slots are two L-shaped slots, wherein said protrusions are engaged with said L-shaped slots to prevent the hinge base from releasing from said groove.

In another preferred embodiment of the present invention, said position limiting structure comprises limiting projections located at the bottom of said grooves and elastic hooks extending downward from the mouth portions of the grooves;

said positioning structure comprises positioning slots and hanging protrusions located at the left and right sides of the hinge bases;

wherein said positioning slots are engaged with said limiting projections respectively and said hanging protrusions are engaged with said elastic hooks respectively so as to prevent the hinge bases from releasing from said grooves.

In the above embodiment, said limiting projections are columnar members extending integrally from the bottom of the grooves;

said positioning slots are slots provided at the front and rear sides of the hinge base respectively and said columnar members are snapped into said slots respectively; and said hanging protrusions are ribs projecting integrally from the left and right side of the hinge base respectively and said elastic hooks are L-shaped members, wherein said ribs are engaged with said elastic hooks respectively so as to prevent the hinge bases from releasing from the grooves.

The present invention further provides a hidden hinge, comprising an upper hinge base, a hinge body and a lower hinge base, as well as said hinge fixing structure according to the above embodiments.

The present invention also provides a container, comprising a bottom, a side plate and a door, wherein, said door and side plate are connected to each other through the hidden hinge described above.

In the present invention, for the container employing the hinge fixing structure and the hidden hinge of the present invention, the hinge is completely invisible from the appearance of the container after installation, and the disassembly of the hinge becomes more convenient.

DRAWINGS

DETAILED DESCRIPTION

Figure 1:
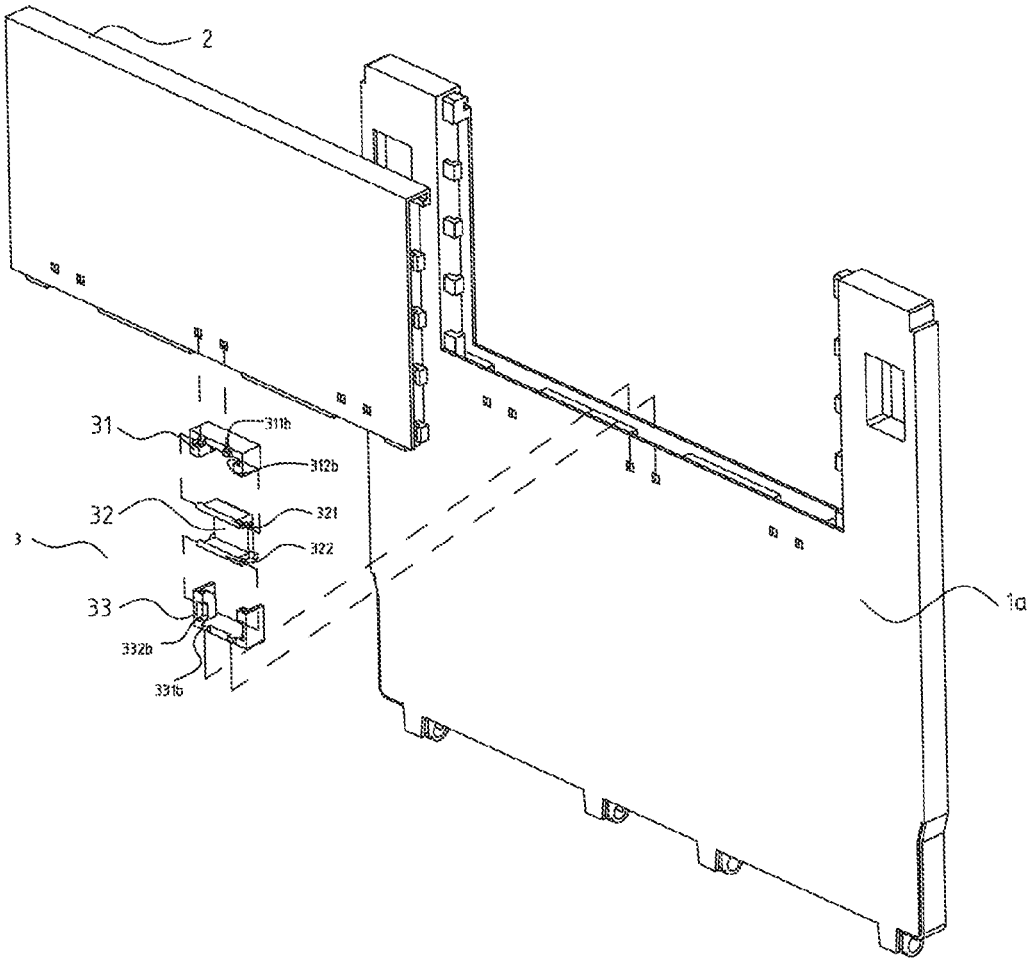
Fig. 1 (Prior Art)
FIG. 1 illustrates a schematic view of a prior art hidden hinge as well as a door and a side plate for mounting the hidden hinge.

Hereinafter, preferred embodiments of the present invention will be described in detail with reference to the drawings so that the purposes, features and advantages of the present invention will be understood more clearly. It should be understood that the embodiments shown in the drawings are not to limit the scope of the invention, but merely to illustrate the true spirit of the technical solution in the present invention. It should be noted, in this specification, upper, lower, left, right, front, and rear refer to orientations of components and specific configurations therein in the drawings, which are not intended to limit their orientations in practical applications.

FIG. 1 illustrates a schematic view of a prior art hidden hinge as well as a door and a side plate for mounting the hidden hinge. As shown in FIG. 1, a hinge assembly 3 includes a hinge body 32, an upper hinge base 31 and a lower hinge base 33, wherein the hinge body 32 comprises upper hinge pins 321 and lower hinge pins 322. Grooves 312*b* in the upper hinge base 31 are used to accommodate the hinge pins 321 and grooves 332*b* in the lower hinge base 33 are used to accommodate the hinge pins 322. Hanging protrusions 311*b* are provided at a side portion of the upper hinge base 31 and hanging protrusions 331*b* are provided at a side portion of the lower hinge base 33. Holes 21 are provided at the sidewall of a door 2, and holes 1*a*1 are provided at the sidewall of a side plate 1*a*, thereby when the upper hinge base 31 and the door 2 are assembled, the sidewall of the door 2 which is squeezed by the hanging protrusions 311*b* will be deformed outwardly, which enables the hanging protrusions 311*b* to be inserted into the holes 21 respectively, thus prevents the upper hinge base 31 from easily releasing from the groove of door 2. Similarly, when the lower hinge base 33 and the side plate la are assembled, the sidewall of side plate 1*a*which is squeezed by the hanging protrusions 331*b* will be deformed outwardly, which enables the hanging protrusions 331*b* to be inserted into the holes 1*a*1, thus prevents lower hinge base 33 from easily releasing from the groove of side plate 1*a*. In this embodiment, the upper and lower hinge bases are installed to the container through the engagement of the protrusions on the hinge bases with the mounting holes on the side plate and the door respectively. However, after the completion of installation, mounting holes and protrusions of hinge bases can still be seen from the appearance of the container.

FIGS. 2-5 illustrates the hinge fixing structure according to the first embodiment of the present invention. Compared with the fixing structure shown in FIG. 1, the sidewalls are free of any holes, which not only improves the appearance of the container, but also increases the strength of the hinge mounting portion.

Figure 2:
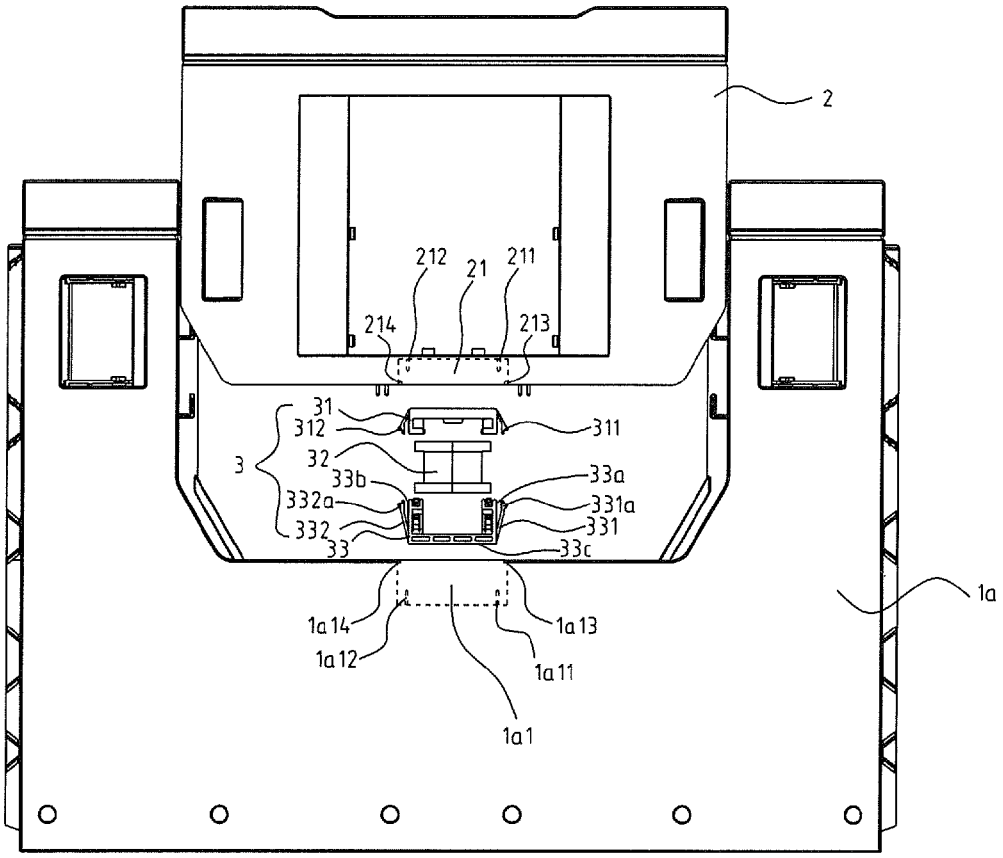
FIG. 2 shows an exploded front view of a hinge fixing structure according to the first embodiment of the present invention.
Figure 3:
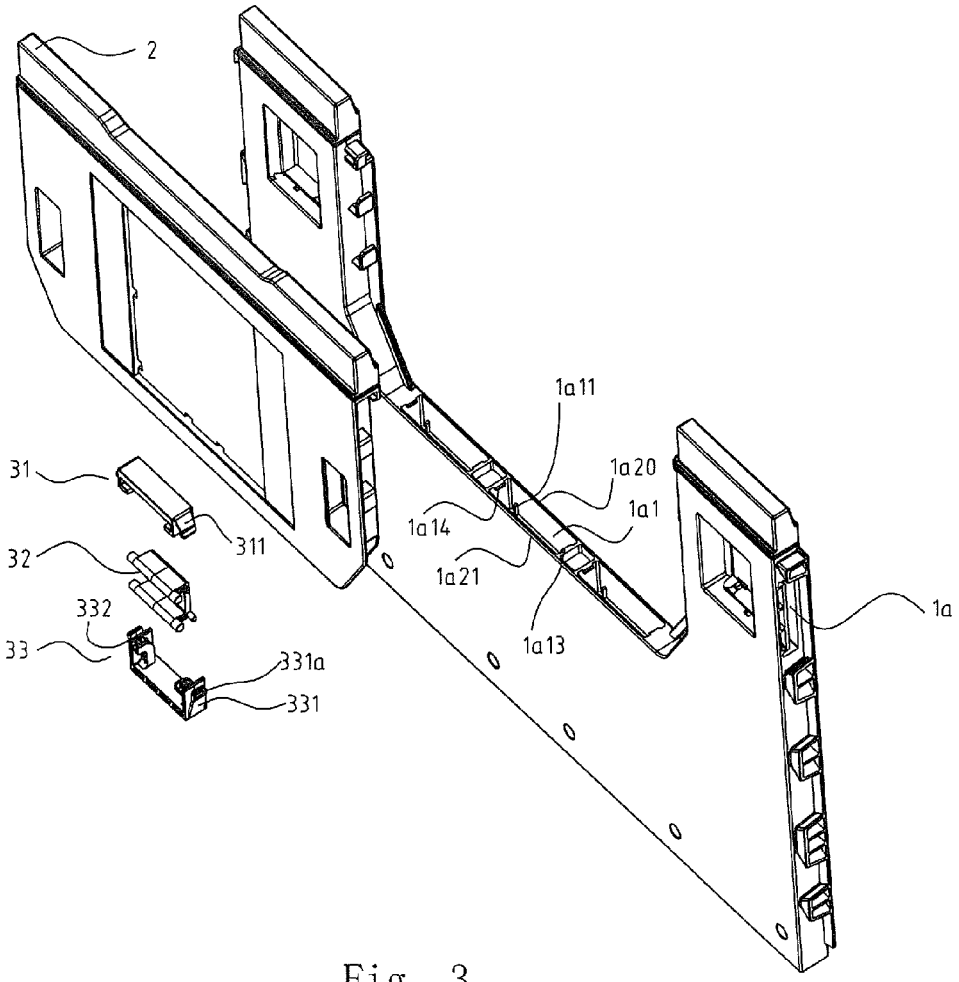
FIG. 3 shows an exploded perspective view of the hinge fixing structure according to the first embodiment of the present invention.

As shown in FIGS. 2-3, the hinge assembly 3 has similar structure to that in FIG. 1. The difference is that the upper hinge base 31 are provided with two branches 311 and 312 with projections, and the lower hinge base 33 are provided with two branches 331 and 332 with projections. Branches 311, 312 and branches 331, 332 have similar structures, hereinafter only the branches 331, 332 provided at both sides of the lower hinge base will be described as examples. As shown in FIGS. 2 and 3, branches 331 and 332 are elastic pieces extending integrally from two sides 33*a*, 33*b* of the lower hinge base at lower surface 33*c* of the lower hinge base respectively, wherein projections 331*a*, 332*a* are provided at the ends of the elastic pieces. Projections 331*a*, 332*a* are used to engage with the hanging protrusions in the groove when the lower hinge base 31 is being installed into groove 1*a*1 of side plate 1*a*, such that the lower hinge base 33 are prevented from releasing from side plate 1*a* after the completion of installation, which will be described in detail below.

Groove 1*a*1 is positioned between two sidewalls 1*a*20 and 1*a*21 of the side plate 1*a*. Positioning ribs 1*a*11, 1*a*12 and hanging protrusions 1*a*13, 1*a*14 providing position limits are provided in the groove 1a1. As shown more clearly in FIG. 3, positioning ribs 1a11, 1a12 are two columnar members extending outwardly from the bottom surface of the groove, wherein the cross section of the columnar members can be selected as desired. In this embodiment, the cross-sectional shape of the columnar members is rectangular. The distance between the positioning rib 1a11 and the positioning rib 1a12 can be determined according to the distance between the two branches 331 and 332 of the lower hinge base 33, so that the hinge base is prevented from moving left and right by the engagement between the positioning ribs and branches. The hanging protrusions 1a13, 1a14 are tabs extending from both sides of the mouth portion of the groove respectively. When the lower hinge base is installed to side plate 1a, the projections 331a, 332a are respectively engaged with the hanging protrusions 1a13, 1a14, which prevents the lower hinge base from releasing from the mouth portion of groove 1a1.

Similarly, the side door 2 is provided with a groove 21 between two side walls. The groove 21 has the same structure as that of the groove 1a1, that is, positioning ribs 211, 212 and hanging protrusions 213, 214 are provided therein, and the hanging protrusions 213, 214 are respectively engaged with the branches 311 and 312, which prevents the upper hinge base from releasing from the groove 21.

Figure 4:
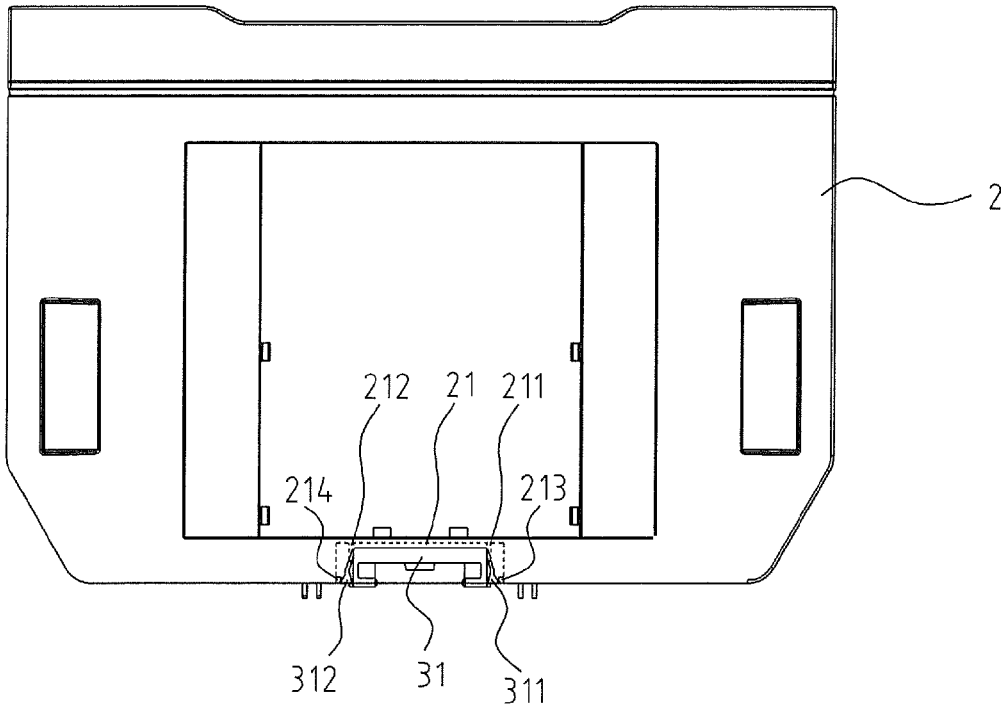
FIGS. 4-5 illustrate the process of installing a hinge assembly with the hinge fixing structure according to the first embodiment to the door.
Figure 5:
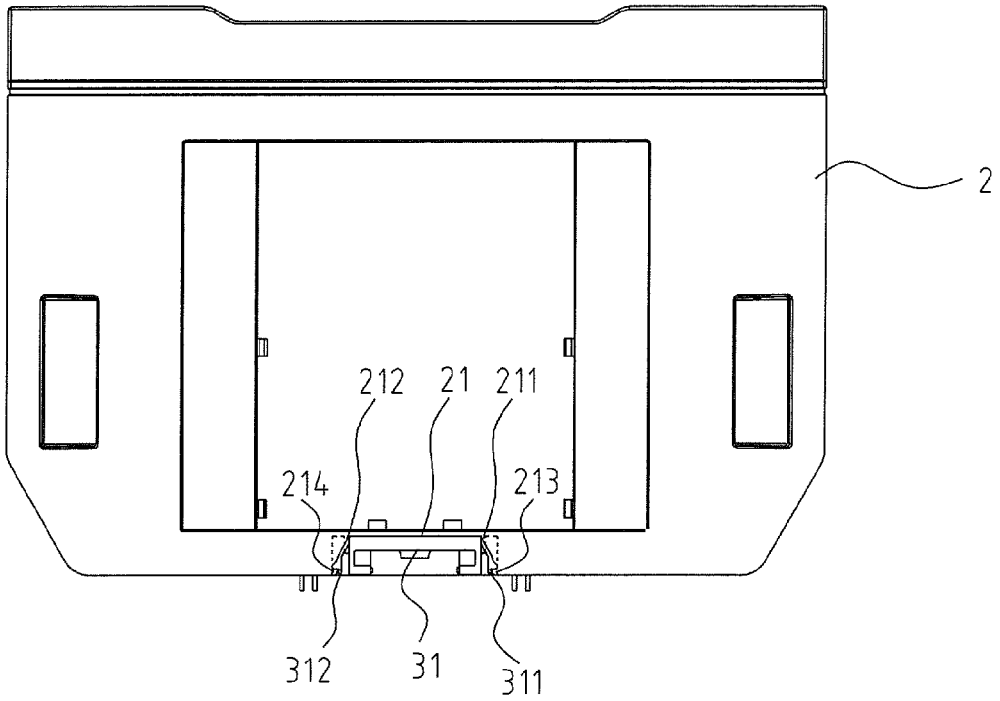

FIGS. 4 and 5 illustrate the process of installing the hinge assembly 3 provided with the hinge structure within the side plate 1a or the door 2. Herein, only the process of installing the upper hinge base 31 to the door 2 will be described as an example. When the upper hinge base 31 is installed into the groove 21 of the door 2, the positioning ribs 211, 212 will firstly contact with upper hinge base 31 so that they could not easily move left and right. At this time, the hanging protrusions 213, 214 of groove 21 prevent the branches 331, 332 from entering groove 21 so that the branches 331, 332 will be bent and deformed inwardly due to their own elasticity, as shown in FIG. 3. The branches 331, 332 would be able to enter groove 21 when the distance between them is not greater than that between hanging protrusions 213, 214. As shown in FIG. 5, when the upper hinge base 31 has been completely installed in the groove 21 of the door 2, the hanging protrusions 213, 214 limit the movement of the projections of the branches 331, 332 toward the mouth portion of the groove. Therefore, the installation of the upper hinge base 31 to the door 2 is realized. The lower hinge base 3 and the side plate 1a are assembled in the same manner, which will not be elaborated herein.

Figure 6:
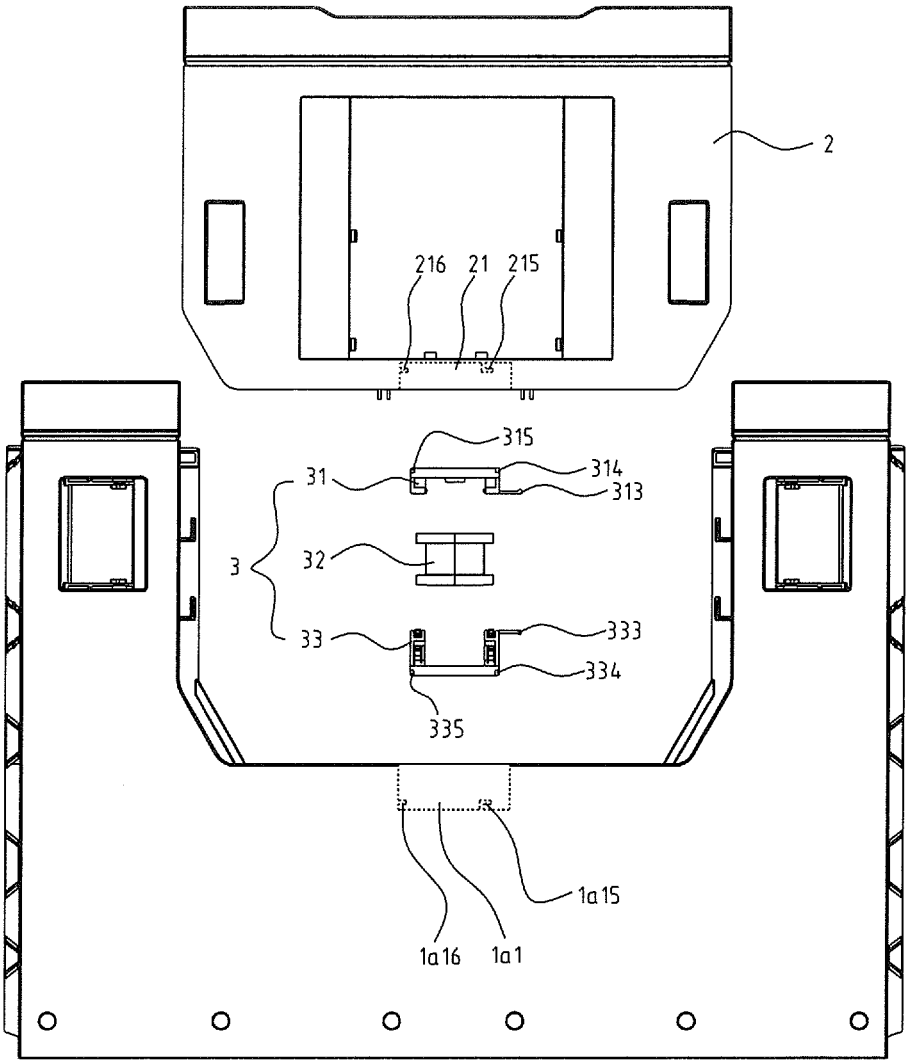
FIG. 6 shows an exploded front view of a hinge fixing structure according to the second embodiment of the present invention.
Figure 7:
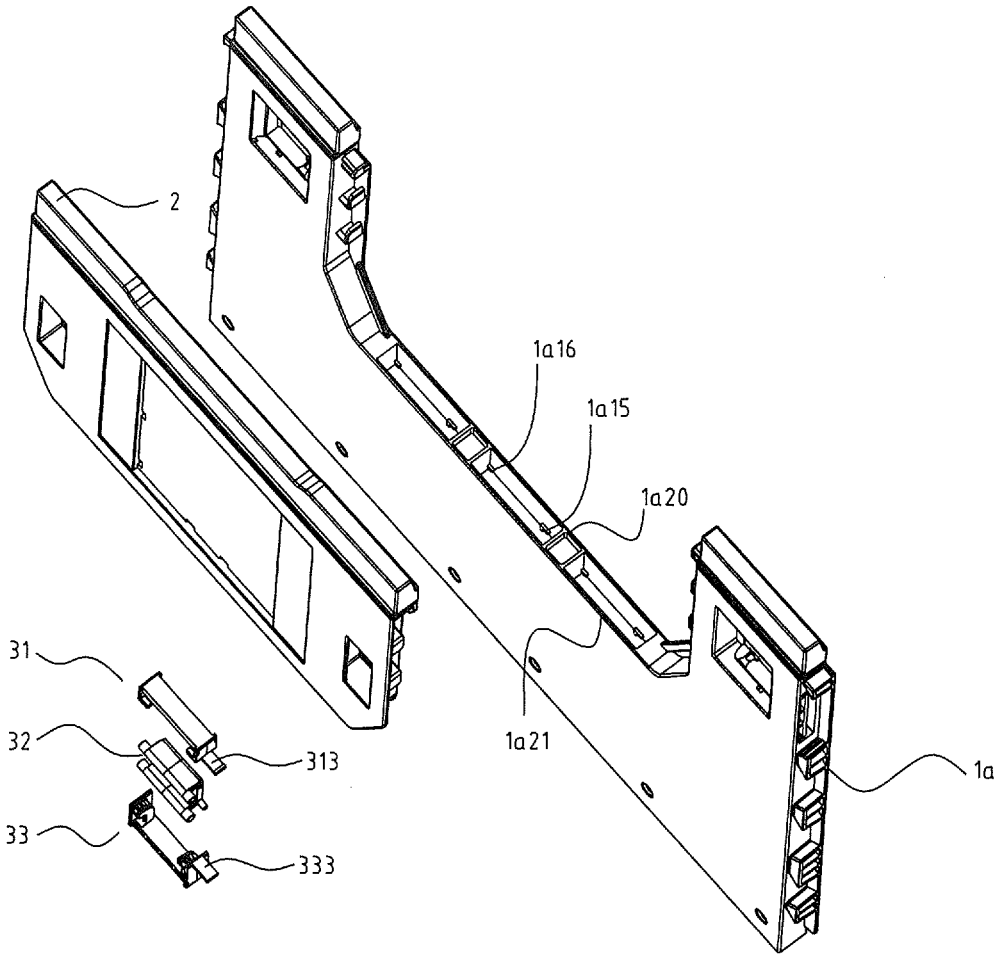
FIG. 7 shows an exploded perspective view of the hinge fixing structure of the second embodiment of the present invention.

FIGS. 6-9 show the hinge fixing structure according to another embodiment of the present invention. In this embodiment, the structure of the hinge assembly 3 is similar to that of the above embodiments, except the hinge fixing structure. As shown in FIGS. 6 and 7, the upper hinge base 31 is provided with hanging protrusions 314, 315 and elastic piece 313 providing a function of positioning. The lower hinge base 33 is also provided with hanging protrusions 334, 335 and elastic piece 333. The hanging protrusions 314 and 215 are respectively protrusions located at the left and right sides of the front (or rear) upper part of the upper hinge base, wherein the elastic piece 313 is a thin sheet extending integrally from the right (or left) upper part of the upper hinge base. Hanging protrusions 334, 335 of lower hinge base 33 are protrusions respectively located at left and right sides of the front (or rear) part of the lower hinge base, wherein the elastic piece 333 is a thin sheet extending integrally from the right upper part of the lower hinge base. The hanging protrusions described above are engaged with hanging slots in grooves of the door and side plate respectively, which prevents the hinge base from releasing from the mouth portion of the groove when the upper hinge base and the lower hinge base are installed respectively to the door and the side plate.

As shown, the door 2 is provided with a groove 21 between two sidewalls, and L-shaped hanging slots 215, 216 providing the function of position limiting are provided within the groove 21. The side plate 1a is provided with a groove 1a1 between two sidewalls 1a20 and 1a21, and hanging slots 1a15, 1a16 are provided within the groove 1a1. The cross-sectional shape of the hanging slots 215, 216 matches the shape of hanging protrusions, and the distance between the hanging slots 215, 216 is determined by the distance between the hanging protrusions 314, 315, which enables the hanging protrusions 314, 315 to be engaged in the hanging slots 215, 216 and prevent them from releasing from the hanging slots. The hanging slots 1a15, 1a16 have the same structure as that of the hanging slots 215, 216, which will not be elaborated herein.

Figure 8:
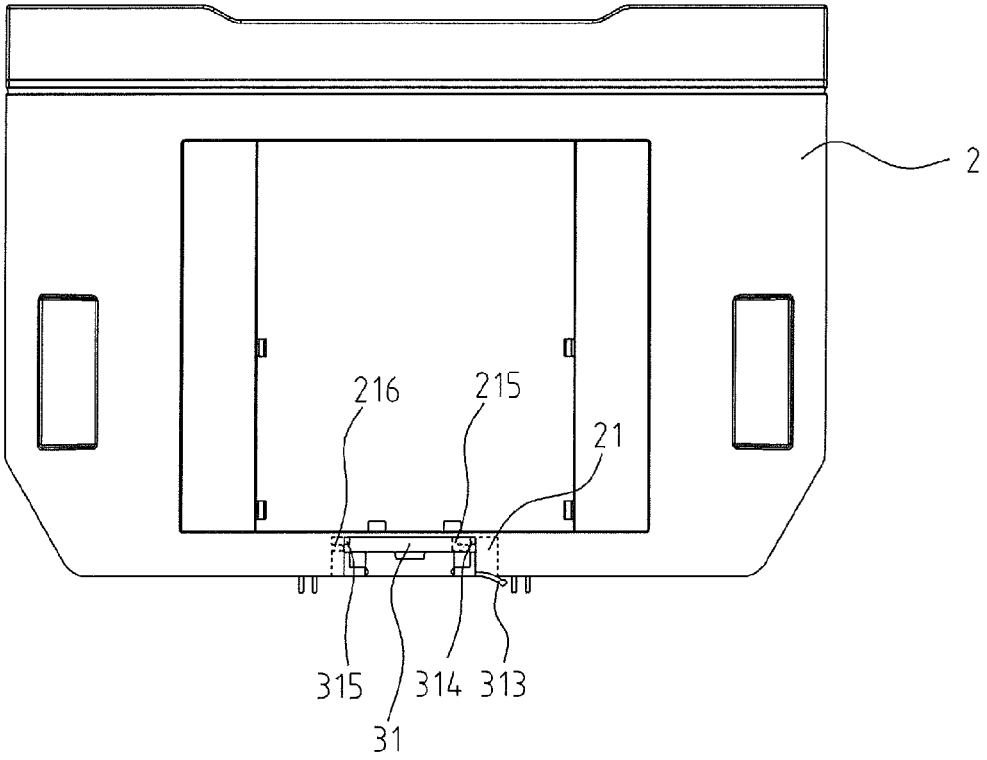
FIGS. 8-9 illustrate the process of installing a hinge assembly with the hinge fixing structure according to the second embodiment to the door.
Figure 9:
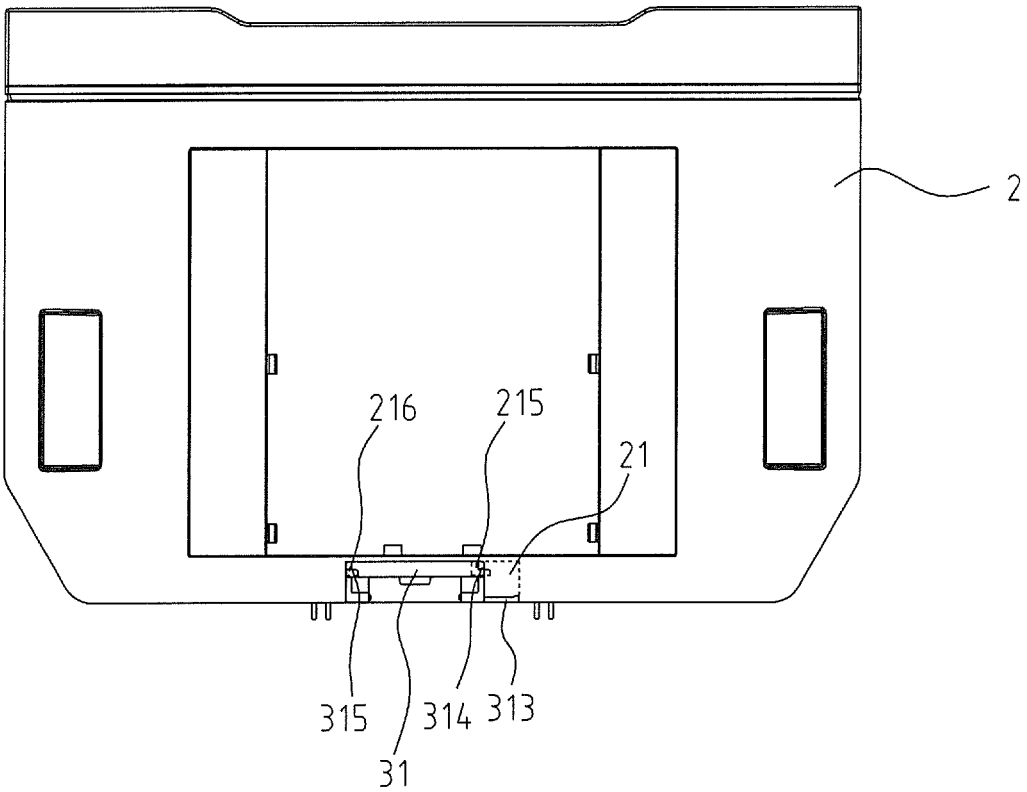

FIGS. 8-9 illustrate the process of installing the hinge assembly with the hinge fixing structure of the present embodiment to the side plate 1a or the door 2. Only the process of installing the upper hinge base 31 to the door 2 is described as an example.

When the upper hinge base 31 is installed in the groove 21 of the door 2, the upper hinge base 31 will slightly offset to the right at first, enabling the hanging protrusions 314, 315 to enter the hanging slots 215, 216 laterally. At this time, the elastic piece 313 of the upper hinge base 31 will be deformed downward due to the obstruction of lateral structure of groove 21, as shown in FIG. 8. At this time, the upper hinge base 31 is further pushed toward the left side so that the hanging protrusions 314, 315 will enter the hanging slots 215, 216, then the elastic piece 313 is no longer blocked by the side structure of the groove 21 and restores its free-form. In this way, the elastic piece 313 can prevent the upper hinge base 31 from further moving to the right and from easily releasing from the hanging slots, (i.e., releasing from the groove 21), thereby achieving the installation of upper hinge base 31 to door 2. The lower hinge base 3 is installed to the side plate 1a in the same manner.

Figure 10:
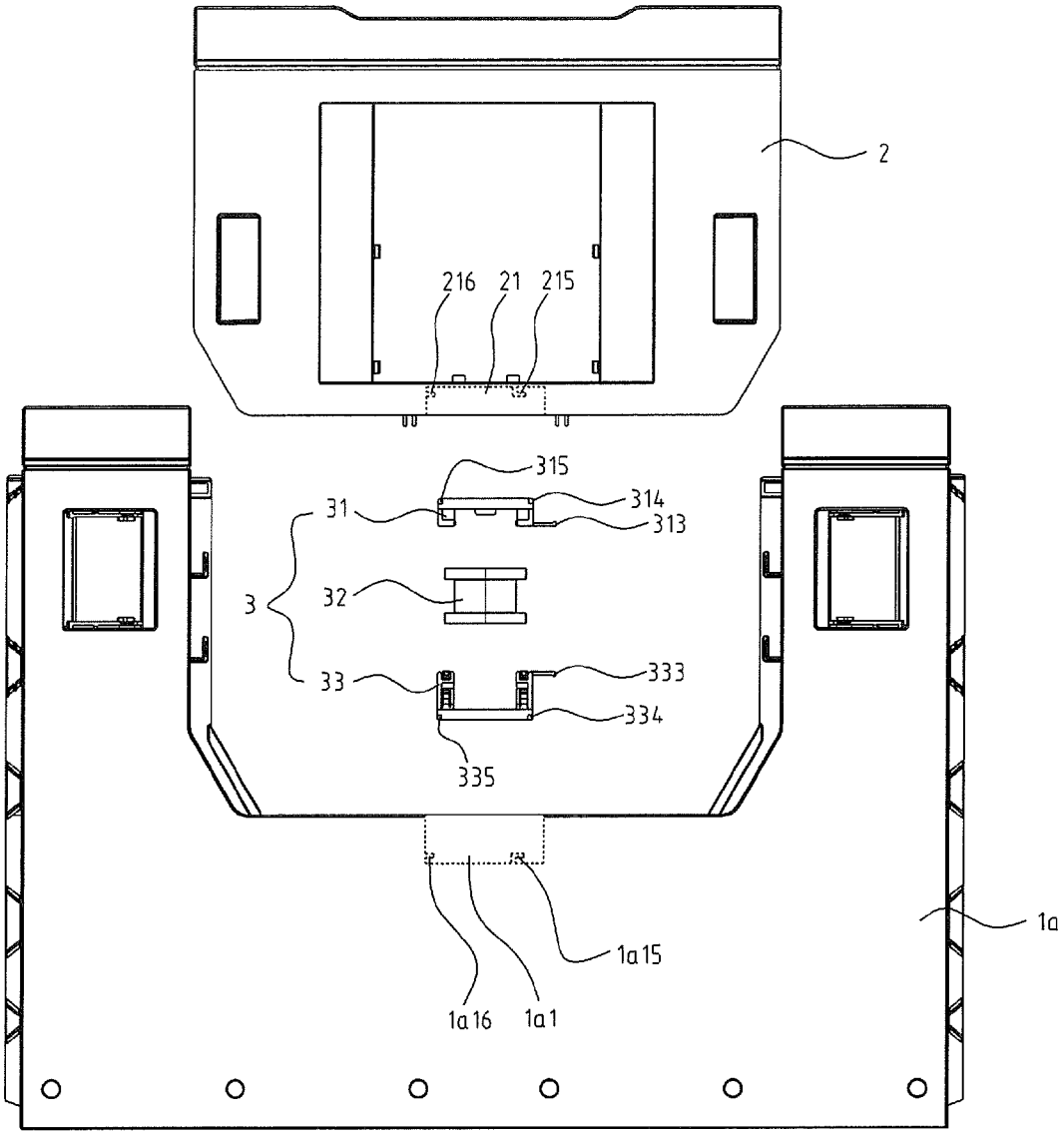
FIG. 10 shows an exploded front view of a hinge fixing structure according to the third embodiment of the present invention.
Figure 11:
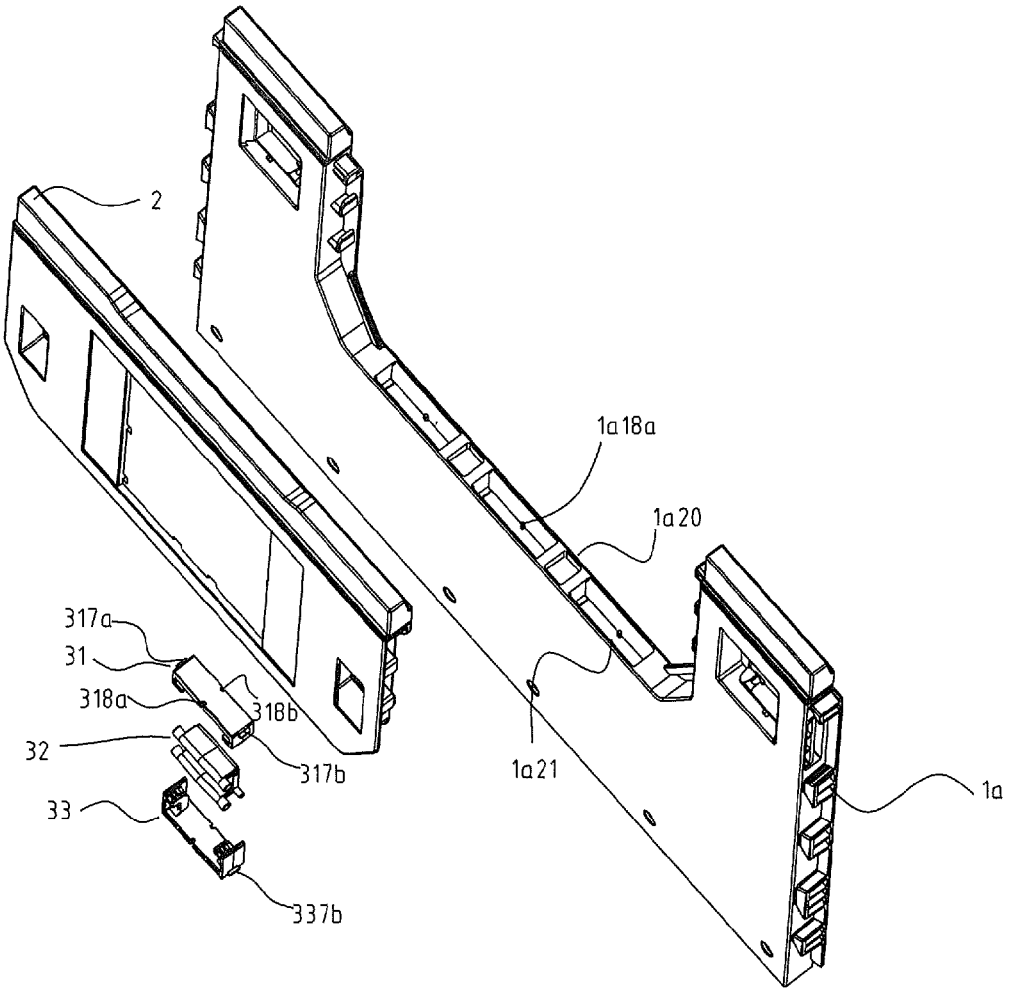
FIG. 11 shows an exploded perspective view of the hinge fixing structure according to the third embodiment of the present invention.

FIGS. 10-13 show the hinge fixing structure according to another embodiment of the invention. In this embodiment, the hinge assembly 3 has similar structure to that of the two embodiments described above, except the hinge fixing structure. As shown in FIGS. 10 and 11, the upper hinge base 31 is provided with hanging protrusions 317a, 317b and positioning slots 318a, 318b. The lower hinge base 33 is also provided with hanging protrusions 337a, 337b and positioning slots 338a, 338b. The hanging protrusions 317a, 317b are respectively ribs projecting integrally from the left and right sides of the upper hinge base, and the positioning slots are slots substantially provided at the front and the rear sides at the middle of the upper hinge base. The hanging protrusions 337a, 337b of the lower hinge base 33 are protrusions respectively located at the left and right lower part of the lower hinge base, and the positioning slots 338 are slots provided at the front and the rear sides at the middle of the lower hinge base. The hanging protrusions and the positioning slots respectively are engaged with limiting projections and elastic hooks located in the door and the side plate respectively, which prevents the hinge bases from releasing from the mouth portion of the grooves when the upper hinge base and the lower hinge base are installed to the door and the side plate respectively.

As shown in FIGS. 10 and 11, the door 2 is provided with a groove 21 located between two sidewalls, and the bottom of the groove 21 is provided with limiting projections 218*a*, 218*b* providing a function of position limiting. Elastic hooks 217*a*, 217*b*, which are substantially L-shaped plate pieces, extend downward from the mouth portion of the groove. The side plate 1*a* is provided with a groove 1*a*1 between two sidewalls 1*a*20, 1*a*21. The bottom of the groove 1*a*1 is provided with limiting projections 1*a*18*a*, 1*a*18*b*. And elastic hooks 1*a*17*a*, 1*a*17*b* extend downward from the mouth portion of the groove. Limiting projections 218*a*, 218*b* are columnar members extending integrally from the bottom, whose shape and size are not with any special requirements, as long as they match those of the positioning slots 318*a*, 318*b*. The shape and size of elastic hooks 217*a*, 217*b* are neither with any special requirements, as long as they match those of hanging protrusions 317*a*, 317*b*, which enables the hanging protrusions 317*a*, 317*b* to snap into the elastic hooks 217*a*, 217*b* after installation and prevents them from releasing from the hanging slots. In this embodiment, the elastic hooks 217*a*, 217*b* are substantially L-shaped. The limiting projections 1*a*18*a*, 1*a*18*b* and the elastic hooks 1*a*17*a*, 1*a*17*b* respectively have the same structure with that of the limiting projections 218*a*, 218*b* and the elastic hooks 217*a*, 217*b*, which will not be elaborated herein.

Figure 12:
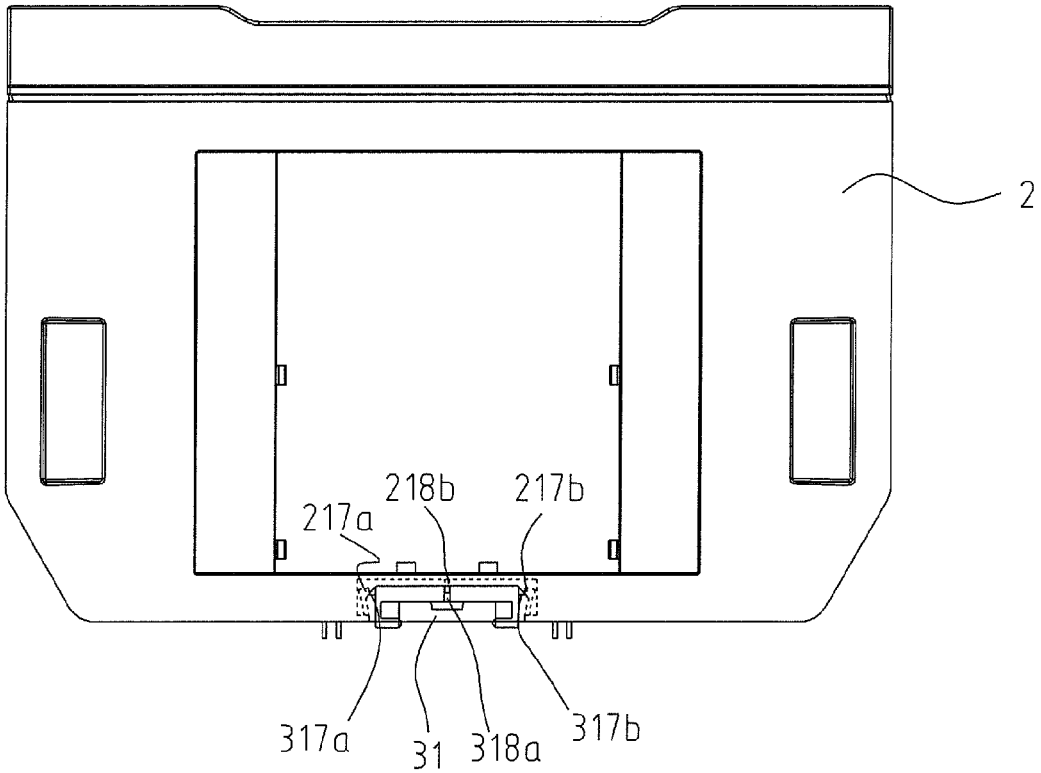
FIGS. 12-13 illustrate the process of installing a hinge assembly with the hinge fixing structure according to the third embodiment to the door.
Figure 13:
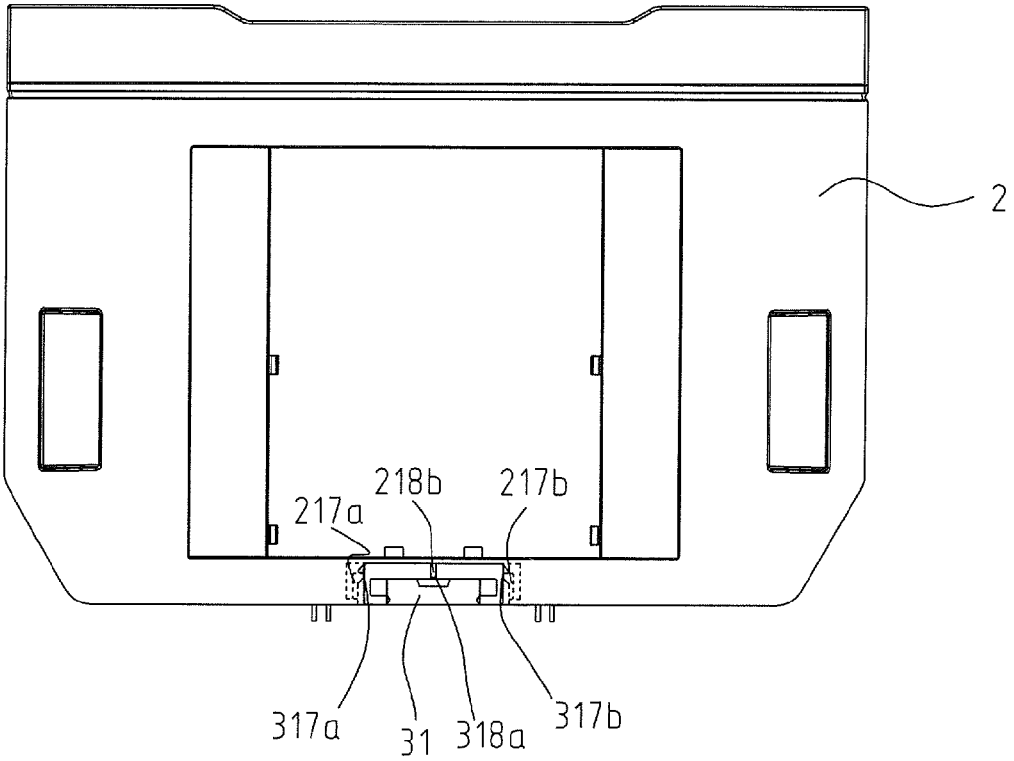

FIGS. 12-13 illustrate the process of installing the hinge assembly 3 with the hinge fixing structure of the present embodiment to the side plate 1*a* or the door 2, here only the process of installing the upper hinge base 31 to the door 2 will be described as an example.

When installing the upper hinge base 31 into the groove 21 of door 2, firstly the positioning slots 318*a*, 318*b* of the upper hinge base 31 are aligned with the limiting projections 218*a*, 218*b* in the groove 21 of the door 2 and the upper hinge base 31 is pressed into the groove 21. Then the hanging protrusions 317*a*, 317*b* of the upper hinge base 31 will press the elastic hooks 217*a*, 217*b*, which makes the elastic hooks to deform, thereby allowing the positioning slots 318*a*, 318*b* to enter the limiting projections 218*a*, 218*b*. When the positioning slots have entered the limiting projections completely, the elastic hooks 217*a*, 217*b* will restore their free-form. In this way, the elastic hooks 217*a*, 217*b* prevent the hinge base 31 from easily releasing from the groove 21, thereby finishing the installation of upper hinge base 31 to door 2. The lower hinge base 33 is installed to the side plate 1*a* in the same manner.

The fixing structure used to hold hinges on the door or the side plate according to the embodiments described above has advantages of simple structure, easy installation and improved appearance, since the hinge assembly would never been seen from the appearance when the door is closed after installation. Further, since the hinge is completely installed between two sidewalls of the door or the side plate, there are no hinge mounting holes on the sidewalls of the door and the side plate, which increases the strength of the hinge mounting portion of the door and the side plate to some extent.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

The invention claimed is:

1. A hinge fixing structure used to hold a hidden hinge on a container, wherein said hidden hinge comprises an upper hinge base, a hinge body and a lower hinge base, and said container comprises a side plate and a door which are respectively provided with grooves formed by internal and external sidewalls thereof and used to accommodate the hinge bases, said hinge fixing structure comprises:

position limiting structures located in said grooves, each of the position limiting structures being formed separately from any of the upper hinge base and the lower hinge base and being used to prevent the hinge bases from releasing from mouth portions of said grooves respectively; and positioning structures provided on said upper hinge base, wherein said position limiting structures are engaged with said positioning structures respectively so that said hidden hinge is held on said container and said hidden hinge is completely invisible from the appearance of said container when the door is closed.

2. The hinge fixing structure according to claim 1, wherein said position limiting structures comprise positioning ribs located at the bottom of the grooves respectively and hanging protrusions located at the mouth portions of said grooves respectively;

said positioning structures are branches extending from left and right sides of the hinge bases; and said positioning ribs are used to prevent the hinge bases from moving around, and said hanging protrusions are engaged with said branches so as to prevent the hinge bases from releasing from said grooves.

3. The hinge fixing structure according to claim 2, wherein said branches are elastic pieces extending integrally from the left and right side of the hinge base respectively, and projections are provided at the ends of said elastic pieces respectively; and said hanging protrusions are tabs extending from both sides of the mouth portions of the grooves, wherein said tabs are engaged with said projections respectively so as to prevent the hinge bases from releasing from said grooves.

4. The hinge fixing structure according to claim 2, wherein said positioning ribs are columnar members extending from the bottom surfaces of the grooves so that said hinge bases are held between two columnar members after installation.

5. The hinge fixing structure according to claim 1, wherein said position limiting structures are hanging slots located at the bottom of said grooves;

said positioning structures comprise elastic pieces extending from the left side or the right side of the hinge bases and hanging protrusions provided on the front side or the rear side of the hinge bases; and said hanging slots are engaged with said hanging protrusions respectively so as to prevent the hinge bases from releasing from said grooves.

6. The hinge fixing structure according to claim 5, wherein said hanging protrusions are two protrusions extending integrally from one of the front and rear sides of each hinge base, and said hanging slots are two L-shaped slots, wherein said protrusions are engaged with said L-shaped slots to prevent each hinge base from releasing from said respective groove.

7. The hinge fixing structure according to claim 1, wherein said position limiting structure comprises limiting projections located at the bottom of said grooves and elastic hooks extending downward from the mouth portions of the grooves;

said positioning structure comprises positioning slots and hanging protrusions located at the left and right sides of the hinge bases;

wherein said positioning slots are engaged with said limiting projections respectively and said hanging protrusions are engaged with said elastic hooks respectively so as to prevent the hinge bases from releasing from said grooves.

8. The hinge fixing structure according to claim 7, wherein said limiting projections are columnar members extending integrally from the bottom of the grooves;

said positioning slots are slots provided at the front and rear sides of the hinge bases respectively and said columnar members are snapped into said slots respectively; and said hanging protrusions are ribs projecting integrally from the left and right side of the hinge bases respectively and said elastic hooks are L-shaped members, wherein said ribs are engaged with said elastic hooks respectively so as to prevent the hinge bases from releasing from the grooves.

9. A hidden hinge, comprising an upper hinge base, a hinge body and a lower hinge base, wherein said hidden hinge has a hinge fixing structure used to hold said hidden hinge on a container, wherein said container comprises a side plate and a door which are respectively provided with grooves formed by internal and external sidewalls thereof and used to accommodate the hinge bases, and said hinge fixing structure comprises:

position limiting structures located in said grooves, each of the position limiting structures being formed separately from any of the upper hinge base and lower hinge base and being used to prevent the hinge bases from releasing from mouth portions of said grooves respectively; and positioning structures provided on said upper hinge base and said lower hinge base, wherein said position limiting structures are engaged with said positioning structures respectively so that said hidden hinge is held on said container and said hidden hinge is completely invisible from the appearance of said container when the door is closed.

10. A container, comprising a bottom, a side plate and a door, wherein said door and side plate are connected to each other through a hidden hinge comprising an upper hinge base, a hinge body and a lower hinge base, wherein said hidden hinge has a hinge fixing structure used to hold the hidden hinge on the container, wherein the side plate and the door are respectively provided with grooves formed by internal and external sidewalls thereof and used to accommodate the hinge bases, and said hinge fixing structure comprises:

position limiting structures located in said grooves, each of the position limiting structures being formed separately from any of the upper hinge base and the lower hinge base and being used to prevent the hinge bases from releasing from mouth portions of said grooves respectively; and positioning structures provided on said upper hinge base and said lower hinge base, wherein said position limiting structures are engaged with said positioning structures respectively so that said hidden hinge is held on said container and said hidden hinge is completely invisible from the appearance of said container when the door is closed.

* * * * *